US007507328B2

(12) United States Patent
Ellis et al.

(10) Patent No.: US 7,507,328 B2
(45) Date of Patent: Mar. 24, 2009

(54) SELECTIVE HYDRODESULFURIZATION AND MERCAPTAN DECOMPOSITION PROCESS WITH INTERSTAGE SEPARATION

(75) Inventors: Edward S. Ellis, Basking Ridge, NJ (US); John P. Greeley, Annandale, NJ (US); Vasant Patel, Sugar Land, TX (US); Murali V. Ariyapadi, Sugar Land, TX (US)

(73) Assignee: ExxonMobile Research and Engineering Company, Annandale, NJ (US)

( * ) Notice: Subject to any disclaimer, the term of this patent is extended or adjusted under 35 U.S.C. 154(b) by 391 days.

(21) Appl. No.: 11/286,579

(22) Filed: Nov. 23, 2005

(65) Prior Publication Data

US 2007/0241031 A1 Oct. 18, 2007

Related U.S. Application Data

(60) Provisional application No. 60/639,253, filed on Dec. 27, 2004.

(51) Int. Cl.
*C10G 45/02* (2006.01)
*C10G 65/02* (2006.01)

(52) U.S. Cl. ..... 208/210; 208/212; 208/213

(58) Field of Classification Search ..... None
See application file for complete search history.

(56) References Cited

U.S. PATENT DOCUMENTS

| | | | | |
|---|---|---|---|---|
| 5,114,562 | A | 5/1992 | Haun et al. | 208/89 |
| 5,968,347 | A * | 10/1999 | Kolodziej et al. | 208/213 |
| 5,985,136 | A | 11/1999 | Brignac et al. | 208/216 R |
| 6,013,598 | A | 1/2000 | Lapinski et al. | 502/305 |
| 6,126,814 | A | 10/2000 | Lapinski et al. | 208/217 |
| 6,231,753 | B1 | 5/2001 | McKnight et al. | 208/217 |
| 6,387,249 | B1 * | 5/2002 | Cook et al. | 208/216 R |
| 6,592,750 | B2 | 7/2003 | Podrebarac et al. | 208/210 |
| 6,855,246 | B2 | 2/2005 | Chapus et al. | 208/210 |
| 6,913,688 | B2 | 7/2005 | Coker et al. | 208/210 |
| 6,972,086 | B2 | 12/2005 | Didillon et al. | 208/210 |

FOREIGN PATENT DOCUMENTS

WO 03/044131 5/2003

* cited by examiner

*Primary Examiner*—Tam M Nguyen
(74) *Attorney, Agent, or Firm*—Paul E. Purwin

(57) ABSTRACT

A process for the selective hydrodesulfurization of olefinic naphtha streams containing a substantial amount of organically-bound sulfur and olefins. The olefinic naphtha stream is selectively desulfurized in a hydrodesulfurization reaction stage. The hydrodesulfurized effluent stream is separated into a light and heavy liquid fraction and the heavier fraction is further processed in a mercaptan destruction reaction stage to reduce the content of mercaptan sulfur in the final product.

20 Claims, 1 Drawing Sheet

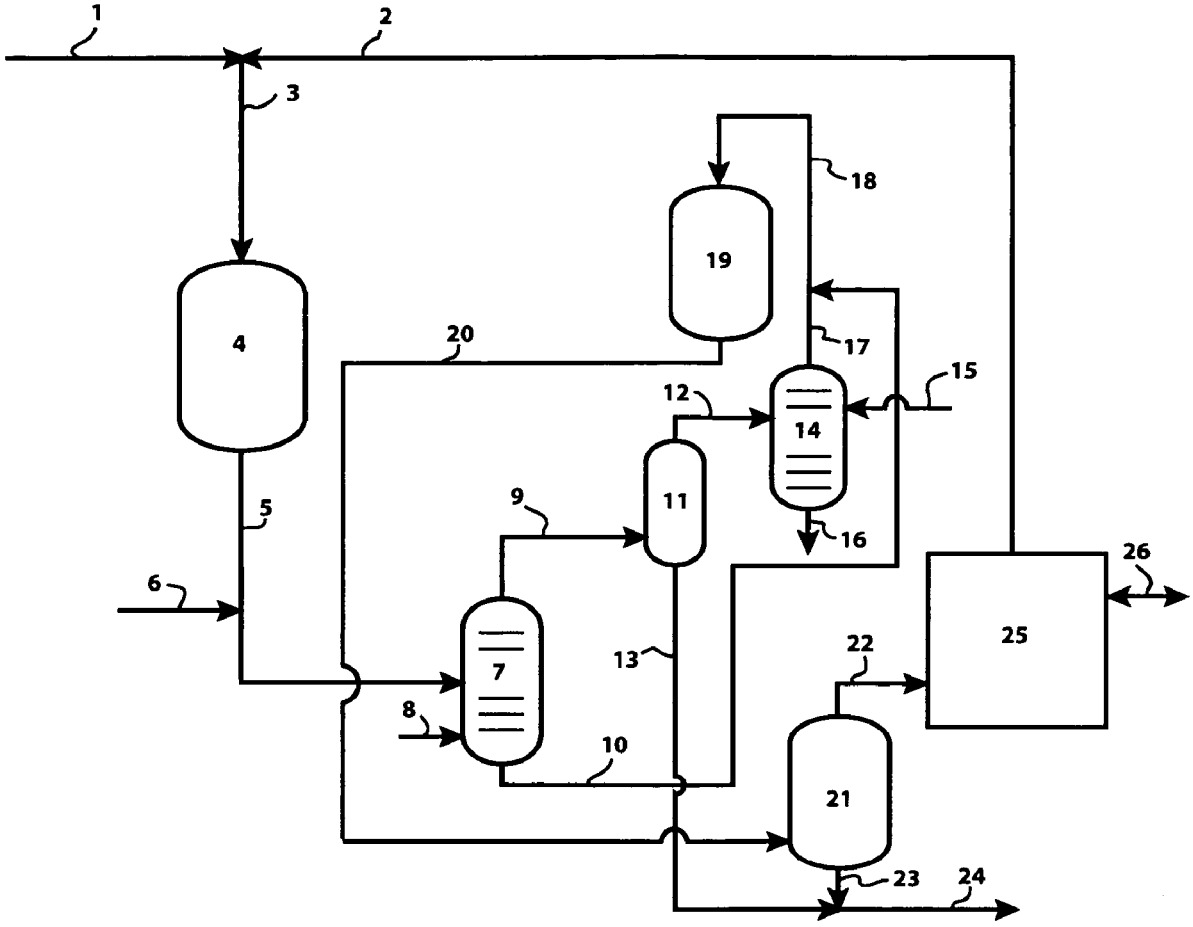
1
2
3
4
5
6
7
8
9
10
11
12
13
14
15
16
17
18
19
20
21
22
23
24
25
26

SELECTIVE HYDRODESULFURIZATION AND MERCAPTAN DECOMPOSITION PROCESS WITH INTERSTAGE SEPARATION

CROSS-REFERENCE TO RELATED APPLICATION

This application claims benefit of U.S. Provisional Patent Application Ser. No. 60/639,253 filed Dec. 27, 2004.

FIELD OF THE INVENTION

The present invention relates to a multi-stage process for the selective hydrodesulfurization and mercaptan removal of an olefinic naphtha stream containing a substantial amount of organically-bound sulfur and olefins.

BACKGROUND OF THE INVENTION

Environmentally-driven, regulatory pressure concerning motor gasoline ("mogas") sulfur levels have resulted in the widespread production of less than 50 wppm sulfur mogas in 2004, and levels below 10 wppm are being considered for later years. In general, this will require deep desulfurization of refinery naphtha streams. The largest target of naphtha streams for such processes are those resulting from cracking operations, particularly those from a fluidized catalytic cracking unit which comprise a large volume of the available refinery blending stock as well as generally higher sulfur content than the "non-cracked" refinery naphtha streams. Naphthas from a fluidized catalytic cracking unit ("cat naphthas") typically contain substantial amounts of both sulfur and olefins. Deep desulfurization of cat naphtha requires improved technology to reduce sulfur levels without the severe loss of octane that accompanies the undesirable hydrogenation of olefins.

Hydrodesulfurization is one of the fundamental hydrotreating processes of refining and petrochemical industries. The removal of feed organically-bound sulfur by conversion to hydrogen sulfide is typically achieved by reaction with hydrogen over non-noble metal sulfided supported and unsupported catalysts, especially those containing Co/Mo or Ni/Mo. This is usually achieved at fairly severe temperatures and pressures in order to meet product quality specifications, or to supply a desulfurized stream to a subsequent sulfur sensitive process.

Olefinic naphthas, such as cracked naphthas and coker naphthas, typically contain more than about 20 wt. % olefins. Conventional fresh hydrodesulfurization catalysts have both hydrogenation and desulfurization activity. Hydrodesulfurization of cracked naphthas using conventional naphtha desulfurization catalysts under conventional startup procedures and under conventional conditions required for sulfur removal, typically leads to an undesirable loss of olefins through hydrogenation. Since olefins are high octane components, it is desirable to retain the olefins rather than to hydrogenate them to saturated compounds that are typically lower in octane. This results in a lower grade fuel product that needs additional refining, such as isomerization, blending, etc., to produce higher octane fuels. Such additional refining, or course, adds significantly to production costs.

Selective hydrodesulfurization to remove organically-bound sulfur, while minimizing hydrogenation of olefins and octane reduction by various techniques, such as selective catalysts and/or process conditions, has been described in the art. For example, a process referred to as SCANfining has been developed by Exxon Mobil Corporation in which olefinic naphthas are selectively desulfurized with little loss in octane. U.S. Pat. Nos. 5,985,136; 6,013,598; and 6,126,814; all of which are incorporated herein by reference, disclose various aspects of SCANfining. Although selective hydrodesulfurization processes have been developed to avoid significant olefin saturation and loss of octane, such processes have a tendency to liberate $H_2S$ that reacts with retained olefins to form mercaptan sulfur compounds by reversion.

As these refinery hydrodesulfurization catalytic processes are operated at greater severities to meet the lower sulfur specifications on products, the $H_2S$ content in the process streams increases, resulting in higher saturation of olefins and reversion to mercaptan sulfur compounds in the products. Therefore, the industry has sought for methods to increase the desulfurization efficiency of a process while reducing or eliminating the amount of reversion of mercaptan sulfur compounds in the final product.

Many refiners are considering combinations of available sulfur removal technologies in order to optimize economic objectives. As refiners have sought to minimize capital investment to meet low sulfur mogas objectives, technology providers have devised various strategies that include distillation of the cracked naphtha into various fractions that are best suited to individual sulfur removal technologies. While economics of such strategies may appear favorable compared to a single processing technology, the complexity of overall refinery operations is increased and successful mogas production is dependent upon numerous critical sulfur removal operations. Economically competitive sulfur removal strategies that minimize olefin saturation and minimize the production of mercaptan sulfur compounds (also referred to as "mercaptans") in the products, as well as decrease the required capital investment and operational complexity will be favored by refiners.

Consequently, there is a need in the art for technology that will reduce the cost and complexity of hydrotreating olefinic naphthas to low levels of sulfur content while either reducing the amount of mercaptans formed or by providing an economical process to destroy the mercaptans that are formed as a resultant of the hydrotreating process. There is a need in the industry for a process to reduce these product mercaptan levels while meeting higher sulfur reduction specifications, minimizing the saturation of olefins, and reducing the loss of octane in the final product.

SUMMARY OF THE INVENTION

In accordance with the present invention, there is provided a process for hydrodesulfurizing an olefinic naphtha feedstream and retaining a substantial amount of the olefins, which feedstream boils in the range of about 50° F. (10° C.) to about 450° F. (232° C.) and contains organically-bound sulfur and an olefin content of at least about 5 wt. %, which process comprises:

a) hydrodesulfurizing said olefinic naphtha feedstream in the presence of a hydrogen-containing treat gas and a hydrodesulfurization catalyst, at hydrodesulfurization reaction stage conditions including temperatures from about 450° F. (232° C.) to about 800° F. (427° C.), pressures of about 60 to about 800 psig (about 515 to about 5,617 kPa), and hydrogen-containing treat gas rates of about 1000 to about 6000 standard cubic feet per barrel (178 to 1,068 $m^3/m^3$), to convert a portion of the elemental and organically-bound sulfur in said olefinic naphtha feedstream to hydrogen sulfide to produce a hydrodesulfurization reaction effluent stream;

b) conducting said hydrodesulfurization reaction effluent stream to an interstage stripping zone operated at a temperature from about 100° F. (38° C.) to about 300° F. (149° C.) and pressures of about 60 to about 800 psig (about 515 to about 5,617 kPa), wherein the hydrodesulfurization reaction effluent stream is contacted with a hydrogen-containing stripping gas and is separated into:
   i) an interstage stripper lower boiling stream which contains substantially all of the $H_2S$, hydrogen, and the lower boiling fraction of said hydrodesulfurization reaction effluent stream, and
   ii) an interstage stripper higher boiling stream, which is higher in mercaptan content by wt. % than said lower boiling fraction of the hydrodesulfurization reaction effluent stream;

c) cooling said interstage stripper lower boiling stream and conducting said interstage stripper lower boiling stream to a first separator zone wherein said interstage stripper lower boiling stream is separated into:
   i) a first separator lower boiling stream containing substantially all of the $H_2S$ and hydrogen from said interstage stripper higher boiling point stream, and
   ii) a first separator higher boiling stream;

d) conducting said first separator lower boiling stream to a scrubbing zone wherein said first separator lower boiling stream is contacted with a lean $H_2S$ scrubbing solution to produce a scrubber overhead stream and a rich $H_2S$ scrubbing solution wherein said scrubber overhead stream is lower in $H_2S$ by wt. % than said first separator lower boiling stream and said rich $H_2S$ scrubbing solution is higher in sulfur by wt. % than said lean $H_2S$ scrubbing solution; and e) combining said interstage stripper higher boiling stream and a second hydrogen-containing treat gas to form a mercaptan decomposition feedstream and heating said mercaptan decomposition feedstream prior to conducting it to a mercaptan decomposition reaction stage that contains a mercaptan decomposition catalyst, at reaction conditions including temperatures from about 500° F. (260° C.) to about 900° F. (482° C.), pressures of about 60 to about 800 psig (about 515 to about 5,617 kPa), and second hydrogen-containing treat gas rates of about 1000 to about 6000 standard cubic feet per barrel (about 178 to about 1,068 $m^3/m^3$), thereby decomposing at least a portion of the mercaptan sulfur to produce a mercaptan decomposition reactor product stream having a lower mercaptan sulfur content by wt. % than said hydrodesulfurization reaction effluent stream.

In a preferred embodiment, the olefinic naphtha feedstream is in the vapor phase prior to contacting said hydrodesulfurization catalyst, and the interstage stripper higher boiling stream is in the vapor phase prior to contacting said mercaptan decomposition catalyst.

In another preferred embodiment, the hydrogen-containing treat gas that is combined with said stripper higher boiling stream is comprised of said scrubber overhead stream.

In another preferred embodiment, said lean $H_2S$ scrubbing solution is an amine solution.

In another preferred embodiment, the total sulfur content of said mercaptan decomposition reactor product stream is less than about 5 wt. % of the total sulfur content of said olefinic naphtha feedstream.

In another preferred embodiment, the mercaptan sulfur content of said mercaptan decomposition reactor product stream is less than about 35 wt. % of the mercaptan sulfur content of said hydrodesulfurization reaction effluent stream.

In another preferred embodiment, the mercaptan sulfur content of said first separator higher boiling stream is less than about 30 wt. % of the mercaptan sulfur content of said hydrodesulfurization reaction effluent stream.

In another preferred embodiment, said hydrodesulfurization catalyst utilized in said hydrodesulfurization reaction stage is comprised of at least one Group VIII metal oxide and at least one Group VI metal oxide; more preferably the Group VIII metal oxide is selected from Fe, Co and Ni, and the Group VI metal oxide is selected from Mo and W.

In another preferred embodiment, the metal oxides are deposited on a high surface area support material; more preferably the high surface area support material is alumina.

In another preferred embodiment, said mercaptan decomposition catalyst is comprised of a refractory metal oxide in an effective amount to catalyze the decomposition of said mercaptan sulfur to $H_2S$.

In another preferred embodiment, said mercaptan decomposition catalyst is comprised of materials selected from alumina, silica, silica-alumina, aluminum phosphates, titania, magnesium oxide, alkali and alkaline earth metal oxides, alkaline metal oxides, magnesium oxide, faujasite that has been ion exchanged with sodium to remove the acidity, and ammonium ion treated aluminum phosphate.

In another preferred embodiment, said mercaptan decomposition catalyst is comprised of materials selected from alumina, silica, and silica-alumina.

In still another preferred embodiment, said mercaptan decomposition catalyst possesses substantially no hydrogenation activity.

BRIEF DESCRIPTION OF THE DRAWING

The FIGURE depicts a preferred process scheme for practicing the present invention.

DETAILED DESCRIPTION OF THE INVENTION

Feedstocks suitable for use in the present invention are olefinic naphtha boiling range refinery streams. The term "olefinic naphtha stream" as used herein are those naphtha streams having boiling ranges of about 50° F. (10° C.) to about 450° F. (232° C.) and having an olefin content of at least about 5 wt. %. Non-limiting examples of olefinic naphtha streams include fluid catalytic cracking unit naphtha (FCC catalytic naphtha or cat naphtha), steam cracked naphtha, and coker naphtha. Also included are blends of olefinic naphthas with non-olefinic naphthas as long as the blend has an olefin content of at least about 5 wt. %.

Olefinic naphtha refinery streams generally contain not only paraffins, naphthenes, and aromatics, but also unsaturates, such as open-chain and cyclic olefins, dienes, and cyclic hydrocarbons with olefinic side chains. The olefinic naphtha feedstock can contain an overall olefins concentration ranging as high as about 60 wt. %, more typically as high as about 50 wt. %, and most typically from about 5 wt. % to about 40 wt. %. The olefmic naphtha feedstock can also have a diene concentration up to about 15 wt. %, but more typically less than about 5 wt. % based on the total weight of the feedstock. High diene concentrations are undesirable since they can result in a gasoline product having poor stability and color. The sulfur content of the olefinic naphtha will generally range from about 300 wppm to about 7000 wppm, more typically from about 1000 wppm to about 6000 wppm, and most typically from about 1500 to about 5000 wppm. The sulfur will typically be present as organically-bound sulfur. That is, as sulfur compounds such as simple aliphatic, naphthenic, and aromatic mercaptans, sulfides, di- and polysulfides and the like. Other organically-bound sulfur compounds include the class of heterocyclic sulfur compounds such as thiophene and its higher homologs and analogs. Nitrogen will also be present and will usually range from about 5 wppm to about 500 wppm.

As previously mentioned, it is highly desirable to remove sulfur from olefinic naphthas with as little olefin saturation as possible. It is also highly desirable to convert as much as possible of the organic sulfur species of the naphtha to hydrogen sulfide with as little mercaptan reversion as possible. The level of mercaptans in the product stream has been found to be directly proportional to the concentration of both hydrogen sulfide and olefinic species at the hydroconversion reactor outlet, and inversely related to the temperature at the reactor outlet.

The FIGURE is a simple flow scheme of a preferred embodiment for practicing the present invention. Various ancillary equipment, such as compressors, pumps, fired heaters, coolers, other heat exchange devices, and valves is not shown for simplicity reasons.

In this preferred embodiment, an olefinic naphtha feed (1) and a hydrogen-containing treat gas stream (2) are incorporated into a combined process feedstream (3). This combined process feedstream is then contacted with a catalyst in a hydrodesulfurization reaction stage (4) that is preferably operated at selective hydrodesulfurization conditions that will vary as a function of the concentration and types of organically-bound sulfur species in the feedstream. By "selective hydrodesulfurization" we mean that the hydrodesulfurization reaction stage is operated in a manner to achieve as high a level of sulfur removal as possible with as low a level of olefin saturation as possible. It is also operated to avoid as much mercaptan reversion as possible. Generally, hydrodesulfurization conditions include temperatures from about 450° F. (232° C.) to about 800° F. (427° C.), preferably from about 500° F. (260° C.) to about 675° F. (357° C.); pressures from about 60 to about 800 psig, preferably from about 150 to about 500 psig (about 1,136 to about 3,549 kPa), more preferably from about 200 to about 400 psig (about 1,480 to about 2,859 kPa); hydrogen feed rates of about 1000 to about 6000 standard cubic feet per barrel (scf/b) (about 178 to about 1,068 $m^3/m^3$), preferably from about 1000 to about 3000 scf/b (about 178 to about 534 $m^3/m^3$); and liquid hourly space velocities of about 0.5 $hr^{-1}$ to about 15 $hr^{-1}$, preferably from about 0.5 $hr^{-1}$ to about 10 $hr^{-1}$, more preferably from about 1 $hr^{-1}$ to about 5 $hr^{-1}$. It is preferred that the feedstream to the hydrodesulfurization reaction stage as well as the mercaptan destruction reaction stage be in the vapor phase when contacting the catalyst. The terms "hydrotreating" and "hydrodesulfurization" are sometimes used interchangeably herein.

Although depicted in the FIGURE as a single reactor, the term "hydrodesulfurization reaction stage" as used in this document should be construed as being comprised of one or more fixed bed reactors each of which can comprise one or more catalyst beds of the same, or different, hydrodesulfurization catalyst. Although other types of catalyst beds can be used, fixed beds are preferred. Non-limiting examples of such other types of catalyst beds that may be used in the practice of the present invention include fluidized beds, ebullating beds, slurry beds, and moving beds. Interstage cooling between reactors, or between catalyst beds in the same reactor, can be employed since some olefin saturation can take place, and olefin saturation as well as the desulfurization reaction are generally exothermic. A portion of the heat generated during hydrodesulfurization can be recovered by conventional techniques. Where this heat recovery option is not available, conventional cooling may be performed through cooling utilities such as cooling water or air, or by use of a hydrogen quench stream. In this manner, optimum reaction temperatures can be more easily maintained. It is preferred that the first hydrodesulfurization stage be configured in a manner and operated under hydrodesulfurization conditions such that from about 40% to about 100%, more preferably from about 60% to about 95%, of the total targeted sulfur removal is reached in the first hydrodesulfurization stage.

Preferred hydrotreating catalysts for use in the hydrodesulfurization reaction stage are those that are comprised of at least one Group VIII metal oxide, preferably an oxide of a metal selected from Fe, Co and Ni, more preferably selected from Co and/or Ni, and most preferably Co; and at least one Group VI metal oxide, preferably an oxide of a metal selected from Mo and W, more preferably Mo, on a high surface area support material, preferably alumina. Other suitable hydrotreating catalysts include zeolitic catalysts, as well as noble metal catalysts where the noble metal is selected from Pd and Pt. It is within the scope of the present invention that more than one type of hydrotreating catalyst be used in the same reaction vessel. The Group VIII metal oxide of the first hydrodesulfurization catalyst is typically present in an amount ranging from about 0.1 to about 20 wt. %, preferably from about 1 to about 12 wt. %. The Group VI metal oxide will typically be present in an amount ranging from about 1 to about 50 wt. %, preferably from about 2 to about 20 wt. %. All metal oxide weight percents are on support. By "on supportA" we mean that the percents are based on the weight of the support. For example, if the support were to weigh 100 grams, then 20 wt. % Group VIII metal oxide would mean that 20 grams of Group VIII metal oxide is on the support.

Preferred catalysts for both the hydrodesulfurization reaction stage will also have a high degree of metal sulfide edge-plane area as measured by the Oxygen Chemisorption Test as described in "Structure and Properties of Molybdenum Sulfide: Correlation of $O_2$ Chemisorption with Hydrodesulfurization Activity," S. J. Tauster et al., *Journal of Catalysis* 63, pp. 515-519 (1980), which is incorporated herein by reference. The Oxygen Chemisorption Test involves edge-plane area measurements made wherein pulses of oxygen are added to a carrier gas stream and thus rapidly traverse the catalyst bed. For example, the oxygen chemisorption will be from about 800 to about 2,800, preferably from about 1,000 to about 2,200, and more preferably from about 1,200 to about 2,000 μmol oxygen/gram $MoO_3$.

The most preferred catalysts for the first and second hydrodesulfurization zone can be characterized by the properties: (a) a $MoO_3$ concentration of about 1 to 25 wt. %, preferably about 2 to 18 wt. %, and more preferably about 4 to 10 wt. %, and most preferably 4 to 8 wt. %, based on the total weight of the catalyst; (b) a CoO concentration of about 0.1 to about 6 wt. %, preferably about 0.5 to about 5.5 wt. %, and more preferably about 1 to about 5 wt. %, also based on the total weight of the catalyst; (c) a Co/Mo atomic ratio of about 0.1 to about 1.0, preferably from about 0.20 to about 0.80, more preferably from about 0.25 to about 0.72; (d) a median pore diameter of about 60 Å to about 200 Å, preferably from about 75 Å to about 175 Å, and more preferably from about 80 Å to about 150 Å; (e) a $MoO_3$ surface concentration of about $0.5\times10^{-4}$ to about $3\times10^{-4}$ grams $MoO_3/m^2$, preferably about $0.75\times10^{-4}$ to about $2.5\times10^{-4}$ grams $MoO_3/m^2$, more preferably from about $1\times10^{-4}$ to $2\times10^{-4}$ grams $MoO_3/m^2$; and (f) an average particle size diameter of less than 2.0 mm, preferably less than about 1.6 mm, more preferably less than about 1.4 mm, and most preferably as small as practical for a commercial hydrodesulfurization process unit.

The hydrodesulfurization catalysts used in the practice of the present invention are preferably supported catalysts. Any suitable refractory catalyst support material, preferably inorganic oxide support materials, can be used as supports for the catalyst of the present invention. Non-limiting examples of suitable support materials include: zeolites, alumina, silica, titania, calcium oxide, strontium oxide, barium oxide, carbons, zirconia, diatomaceous earth, lanthanide oxides including cerium oxide, lanthanum oxide, neodynium oxide, yttrium oxide, and praseodymium oxide; chromia, thorium oxide, urania, niobia, tantala, tin oxide, zinc oxide, and aluminum phosphate. Preferred are alumina, silica, and silica-alumina. More preferred is alumina. Magnesia can also be used for the catalysts with a high degree of metal sulfide edge-plane area of the present invention. It is to be understood that the support material can also contain small amounts of contaminants, such as Fe, sulfates, silica, and various metal oxides that can be introduced during the preparation of the support material. These contaminants are present in the raw materials used to prepare the support and will preferably be present in amounts less than about 1 wt. %, based on the total weight of the support. It is more preferred that the support material be substantially free of such contaminants. It is an embodiment of the present invention that about 0 to about 5 wt. %, preferably from about 0.5 to about 4 wt. %, and more preferably from about 1 to about 3 wt. %, of an additive be present in the support, which additive is selected from the group consisting of phosphorus and metals or metal oxides from Group IA (alkali metals) of the Periodic Table of the Elements.

Returning now to the FIGURE thereof, the hydrodesulfurization reaction effluent stream (5) from the hydrodesulfurization reaction stage (4) is conducted to an interstage stripping zone (7). Water (6) may be optionally added to the hydrodesulfurization reaction effluent stream to minimize the deposition of salt compounds in system piping and equipment. In the interstage stripping zone (7), a hydrogen-containing stripping gas (8) is contacted with the hydrodesulfurization reaction effluent stream in a preferably counter-flow arrangement. Generally, the interstage stripping zone conditions include temperatures from about 100° F. (38° C.) to about 300° F. (149° C.), preferably from about 140° F. (60° C.) to about 260° F. (127° C.), and pressures from about 60 to about 800 psig (about 515 to about 5,617 kPa), preferably from about 150 to about 500 psig (about 1,136 to about 3,549 kPa). The hydrogen-containing stripping gas rate in the interstage stripping zone is generally about 50 scf/b to about 500 scf/b (about 9 $m^3/m^3$ to about 89 $m^3/m^3$); more preferably about 100 scf/b to about 300 scf/b (about 18 $m^3/m^3$ to about 53 $m^3/m^3$).

In this interstage stripping zone (7), the hydrodesulfurization reaction stream is separated into an interstage stripper lower boiling stream (9) which is comprised of substantially all of the $H_2S$, hydrogen, and the lower boiling hydrocarbon fraction of the hydrodesulfurization reaction effluent stream, and an interstage stripper higher boiling stream (10) which contains the higher boiling hydrocarbon fraction as well as most of the reversion mercaptans that were present in the hydrodesulfurization reaction stream. The interstage stripper lower boiling stream (9) is then cooled and conducted to a first separator zone (11) which operates from about 80° F. (27° C.) to about 130° F. (55° C.), and pressures from about 60 to about 800 psig (about 515 to about 5,617 kPa), preferably from about 150 to about 500 psig (about 1,136 to about 3,549 kPa). In this zone, the interstage stripper lower boiling stream is separated into a first separator lower boiling stream (12) which contains substantially all of the $H_2S$ and hydrogen from the interstage stripper lower boiling stream; and a first separator higher boiling stream (13) which contains most of the hydrocarbon material from the interstage stripper lower boiling stream and is low in reversion mercaptan content and can therefore be sent directly to other refinery finishing units or product blending.

The first separator lower boiling stream (12) is then conducted to a scrubbing zone (14) wherein the stream is contacted with a lean $H_2S$ scrubbing solution (15) to remove the $H_2S$ from the stream. A rich $H_2S$ scrubbing solution (16) is removed from the scrubbing zone (14). It is preferred that the process stream and the lean $H_2S$ scrubbing solution are in a counter-flow arrangement in the scrubbing zone. The utilization of high contact area configurations such as trays, grid packing, packing rings, etc. inside the scrubbing zone vessel is preferred. An amine solution is a preferred composition for the lean $H_2S$ scrubbing solution in this application. A hydrogen-rich scrubber overhead stream (17) with a reduced $H_2S$ content exits the scrubbing zone (14). In a preferred configuration, this scrubber overhead stream (17) is combined with the interstage stripper higher boiling stream (10) to form the mercaptan decomposition feedstream (18). However, it should be noted that separate hydrogen-containing streams may also be utilized to supply the required hydrogen or a portion of the required hydrogen to be combined with the interstage stripper higher boiling stream (10) at this point in the process.

The mercaptan decomposition feedstream (18) is then heated and conducted to a mercaptan decomposition reaction stage (19). In the mercaptan decomposition reaction stage, the mercaptan concentration of the hydrocarbon stream is reduced substantially via catalytic conversion of the mercaptans back to $H_2S$ and olefins.

This mercaptan decomposition reaction stage can be comprised of one or more fixed-bed reactors, each of which can comprise one or more catalyst beds of the same, or different, mercaptan decomposition catalyst. Although other types of catalyst beds can be used, fixed beds are preferred. Non-limiting examples of such other types of catalyst beds that may be used in the practice of the present invention include fluidized beds, ebullating beds, slurry beds, and moving beds. The mercaptan decomposition catalysts suitable for use in this invention are those which contain a material that catalyzes the mercaptan reversal back to $H_2S$ and olefins. Suitable mercaptan decomposition catalytic materials for this process include refractory metal oxides resistant to sulfur and hydrogen at high temperatures and which possess substantially no hydrogenation activity. Catalytic materials which possess substantially no hydrogenation activity are those which have virtually no tendency to promote the saturation or partial saturation of any non-saturated hydrocarbon molecules, such as aromatics and olefins, in a feedstream under mercaptan decomposition reaction stage conditions as disclosed in this invention. These catalytic materials specifically exclude catalysts containing metals, metal oxides, or metal sulfides of the Group V, VI, or VIII elements, including but not limited to V, Nb, Ta, Cr, Mo, W, Fe, Ru, Co, Rh, Ir, Ni, Pd, and Pt. Illustrative, but non-limiting, examples of suitable catalytic materials for the mercaptan decomposition reaction process of this invention include alumina, silica, silica-alumina, aluminum phosphates, titania, magnesium oxide, alkali and alkaline earth metal oxides, alkaline metal oxides, magnesium oxide supported on alumina, faujasite that has been ion exchanged with sodium to remove the acidity and ammonium ion treated aluminum phosphate.

Generally, the mercaptan decomposition reaction stage conditions include: temperatures from about 500° F. (260° C.) to about 900° F. (482° C.), preferably from about 600° F. (316° C.) to about 800° F. (427° C.); pressures from about 60 to about 800 psig (about 515 to about 5,617 kPa), preferably from about 120 to about 470 psig (about 929 to about 3,342 kPa); hydrogen feed rates of about 1000 to about 6000 standard cubic feet per barrel (scf/b) (about 178 to about 1,068 $m^3/m^3$), preferably from about 1000 to about 3000 scf/b (about 178 to about 534 $m^3/m^3$); and liquid hourly space velocities of about 0.5 $hr^{-1}$ to about 15 $hr^{-1}$, preferably from about 1 $hr^{-1}$ to about 10 $hr^{-1}$, more preferably from about 2 $hr^{-1}$ to about 6 $hr^{-1}$.

Returning to the FIGURE, the mercaptan decomposition reactor product stream (20) is cooled and conducted to a second separator zone (21). This second separator zone generally operates at temperatures from about 80° F. (27° C.) to about 130° F. (55° C.), and pressures from about 60 to about 800 psig (about 515 to about 5,617 kPa), preferably from about 130 to about 470 psig (about 998 to about 3,342 kPa). In this second separator zone, the mercaptan decomposition reactor product stream is separated into a second separator lower boiling stream (22) comprised of hydrogen, $H_2S$, light gases and light hydrocarbons (primarily $C_4$ and lighter) which would normally be routed to the hydrogen makeup or recycle system (25), but may also be routed to other refinery processes such as light ends recovery, fuel gas, or waste gas (26). The second separator higher boiling stream (23) which has a reduced mercaptan content is drawn from the second separator zone where it can optionally be combined with the first separator higher boiling stream (13) which also has a low mercaptan concentration for further processing or product blending.

The process of the present invention results in a hydrodesulfurized naphtha product with a lower mercaptan content and higher retained olefin concentration than comparable conventional hydrodesulfurization processes without a mercaptan decomposition stage. Another benefit of this process is the high pressure interstage stripping and the low mercaptan decomposition reaction pressures which allow the hydrogen-containing treat gas from the first stage to be recycled into the mercaptan decomposition stage without recompression. A third benefit is the ability to eliminate the need for quench gas in the hydrodesulfurization stage while still meeting sulfur specifications. These last two benefits of the present invention combine to result in a process with a significant reduction in required capital expenditures, hydrogen consumption and energy savings due to the smaller size of the hydrogen compression system required to operate the process of the present invention as compared to the prior art.

The following example is presented to illustrate the invention.

EXAMPLE

In this example, three process configurations were evaluated based on a kinetic model developed from a pilot plant database. Case 1 is based upon a conventional single stage hydrodesulfurization ("HDS") process configuration with no mercaptan decomposition stage. Case 2 is based upon the same conventional single stage hydrodesulfurization process configuration as Case 1 with an added mercaptan decomposition stage but with no interstage stripping zone. Case 3 is based upon the same conventional single stage hydrodesulfurization process configuration as Case 2 with an interstage stripping zone added prior to the mercaptan decomposition stage. Case 3 is the process configuration of the present invention.

The processes were modeled with the same feedstock composition. All three processes were constrained to all meet the same product total sulfur target of 20 wppm. The feedstock compositional data is shown in Table 1 for all three cases. As can be seen, the same feedstock composition is utilized in all three cases.

TABLE 1

| FEEDSTOCK COMPOSITION | CASE 1 Single Stage HDS | CASE 2 Single Stage HDS with Mercaptan Decomposition | CASE 3 Single Stage HDS with Mercaptan Decomposition & Interstage Stripping |
|---|---|---|---|
| Total Feed Rate (bbl/D) | 65,000 | 65,000 | 65,000 |
| Specific Gravity (@ 60° F. (16° C.) | 0.76 | 0.76 | 0.76 |
| Sulfur (wppm) | 1741 | 1741 | 1741 |
| Bromine Number (cg/g) | 57.7 | 57.7 | 57.7 |
| Olefins (liquid volume %) | 34.5 | 34.5 | 34.5 |
| Aromatics (liquid volume %) | 27.4 | 27.4 | 27.4 |

The hydrodesulfurization reaction conditions for all three cases are shown in Table 2.

TABLE 2

| HYDRODESULFURIZATION REACTION CONDITIONS | CASE 1 Single Stage HDS | CASE 2 Single Stage HDS with Mercaptan Decomposition | CASE 3 Single Stage HDS with Mercaptan Decomposition & Interstage Stripping |
|---|---|---|---|
| Reactor Average Temp-° F. (° C.) | 525 (274) | 525 (274) | 525 (274) |
| Reactor Average Pressure-psig (kPa) | 255 (1860) | 255 (1860) | 255 (1860) |

TABLE 2-continued

| HYDRODESULFURIZATION REACTION CONDITIONS | CASE 1 Single Stage HDS | CASE 2 Single Stage HDS with Mercaptan Decomposition | CASE 3 Single Stage HDS with Mercaptan Decomposition & Interstage Stripping |
|---|---|---|---|
| Treat Gas Rate-scf/b ($m^3/m^3$) | 2,500 (445) | 2,500 (445) | 2,500 (445) |
| Quench Gas Rate-scf/b ($m^3/m^3$) | 2,500 (445) | 1,200 (214) | 0 |

The mercaptan decomposition reaction conditions for all three cases are shown in Table 3.

TABLE 3

| MERCAPTAN DECOMPOSITION REACTION CONDITIONS | CASE 1 Single Stage HDS | CASE 2 Single Stage HDS with Mercaptan Decomposition | CASE 3 Single Stage HDS with Mercaptan Decomposition & Interstage Stripping |
|---|---|---|---|
| Reactor Average Temp-° F. (° C.) | — | 654 (346) | 642 (339) |
| Reactor Inlet Pressure-psig (kPa) | — | 225 (1653) | 225 (1653) |

The liquid product quality results are shown for all three cases in Table 4.

TABLE 4

| LIQUID PRODUCT QUALITY | CASE 1 Single Stage HDS | CASE 2 Single Stage HDS with Mercaptan Decomposition | CASE 3 Single Stage HDS with Mercaptan Decomposition & Interstage Stripping |
|---|---|---|---|
| Total Sulfur (wppm) | 20.0 | 20.0 | 20.0 |
| Mercaptan Sulfur (wppm) | 20.0 | 19.9 | 9.2 |
| Bromine Number (cg/g) | 22.2 | 29.9 | 42.6 |
| Olefins (liquid volume %) | 13.2 | 17.9 | 25.5 |
| Octane Loss ([RON + MON]/2) | 4.4 | 3.3 | 1.4 |

As shown by the above product quality data, the mercaptan decomposition with interstage stripping of the present invention (Case 3) results in a product with an octane value 3.0 points higher than a comparable process consisting of a single stage hydrodesulfurization without a mercaptan decomposition stage. The present invention also results in a product with an octane value 1.9 points higher than a comparable process consisting of hydrodesulfurization and mercaptan decomposition stages without interstage stripping.

Another benefit that can be seen from the process data is that the present invention (Case 3) can meet the same sulfur specifications as in Case 1 and Case 2 without the need for the substantial quantity of additional quench gas. As can be seen in Table 2, Case 1 required 2,500 scf/b (445 $m^3/m^3$) of quench gas and Case 2 required 1,200 scf/b (214 $m^3/m^3$) of quench gas to meet the same product total sulfur specifications as the present invention which required no quench gas. This results in a hydrodesulfurization process that significantly reduces the required capital expenditures, hydrogen consumption and energy costs by reducing the size of the hydrogen compression system required to operate the process of the present invention as compared with the prior art.

The invention claimed is:

1. A process for hydrodesulfurizing an olefinic naphtha feedstream and retaining a substantial amount of the olefins, which feedstream boils in the range of about 50° F. (10° C.) to about 450° F. (232° C.) and contains organically-bound sulfur and an olefin content of at least about 5 wt. %, which process comprises: a) hydrodesulfurizing said olefinic naphtha feedstream in the presence of a hydrogen-containing treat gas and a hydrodesulfurization catalyst, at hydrodesulfurization reaction stage conditions including temperatures from about 450° F. (232° C.) to about 800° F. (427° C.), pressures of about 60 to about 800 psig (about 515 to about 5,617 kPa), and hydrogen-containing treat gas rates of about 1000 to about 6000 standard cubic feet per barrel (about 178 to about 1,068 $m^3/m^3$), to convert a portion of the elemental and organically-bound sulfur in said olefinic naphtha feedstream to hydrogen sulfide to produce a hydrodesulfurization reaction effluent stream; b) conducting said hydrodesulfurization reaction effluent stream to an interstage stripping zone operated at a temperature from about 100° F. (38° C.) to about 300° F. (149° C.) and pressures of about 60 to about 800 psig (about 515 to about 5,617 kPa), wherein said hydrodesulfurization reaction effluent stream is contacted with a hydrogen-containing stripping gas and is separated into: i) an interstage stripper lower boiling stream which contains substantially all of the $H_2S$, hydrogen, and the lower boiling fraction of said hydrodesulfurization reaction effluent stream, and ii) an interstage stripper higher boiling stream which is higher in mercaptan content by wt. % than said lower boiling fraction of the hydrodesulfurization reaction effluent stream; c) cooling said interstage stripper lower boiling stream and conducting said interstage stripper lower boiling stream to a first separator zone wherein said interstage stripper lower boiling stream is separated into: i) a first separator lower boiling stream containing substantially all of the $H_2S$ and hydrogen from said interstage stripper lower boiling point stream, and ii) a first separator higher boiling stream; d) conducting said first separator lower boiling stream to a scrubbing zone wherein said first separator lower boiling stream is contacted with a lean $H_2S$ scrubbing solution to produce a scrubber overhead stream and a rich $H_2S$ scrubbing solution wherein said scrubber overhead stream is lower in $H_2S$ by wt. % than said first separator lower boiling stream and said rich $H_2S$ scrubbing solution is higher in sulfur by wt. % than said lean $H_2S$ scrubbing solution; and e) combining said interstage stripper higher boiling stream and a second hydrogen-containing treat gas to form a mercaptan decomposition feedstream and heating said mercaptan decomposition feedstream prior to conducting it to a mercaptan decomposition reaction stage that contains a mercaptan decomposition catalyst, said mercaptan decomposition catalyst possessing substantially no hydrogenation activity, at reaction conditions including temperatures from about 500° F. (260° C.) to about 900° F. (482° C.), pressures of about 60 to about 800 psig (about 515 to about 5,617 kPa), and second hydrogen-containing treat gas rates of about 1000 to about 6000 standard cubic feet per barrel (about 178 to about 1,068 $m^3/m^3$), thereby decomposing at least a portion of the mercaptan sulfur to produce a mercaptan decomposition reactor product stream having a lower mercaptan sulfur content by wt. % than said hydrodesulfurization reaction effluent stream.

2. The process of claim 1, wherein said olefinic naphtha feedstream is in the vapor phase prior to contacting said hydrodesulfurization catalyst, and said stripper higher boiling stream is in the vapor phase prior to contacting said mercaptan decomposition catalyst.

3. The process of claim 2, wherein said second hydrogen-containing treat gas is comprised of said scrubber overhead stream.

4. The process of claim 3, wherein said lean $H_2S$ scrubbing solution is an amine solution.

5. The process of claim 1, wherein the total sulfur content of said mercaptan decomposition reactor product stream is less than about 5 wt. % of the total sulfur content of said olefinic naphtha feedstream.

6. The process of claim 5, wherein the mercaptan sulfur content of said mercaptan decomposition reactor product stream is less than about 35 wt. % of the mercaptan sulfur content of said hydrodesulfurization reaction effluent stream.

7. The process of claim 6, wherein the mercaptan sulfur content of said first separator higher boiling stream is less than about 30 wt. % of the mercaptan sulfur content of said hydrodesulfurization reaction effluent stream.

8. The process of claim 1, wherein said hydrodesulfurization catalyst utilized in said hydrodesulfurization reaction stage is comprised of at least one Group VIII metal oxide and at least one Group VI metal oxide.

9. The process of claim 8, wherein said hydrodesulfurization catalyst utilized in said hydrodesulfurization reaction stage is comprised of at least one Group VIII metal oxide selected from Fe, Co and Ni, and at least one Group VI metal oxide, selected from Mo and W.

10. The process of claim 9, wherein said metal oxides are deposited on a high surface area support material.

11. The process of claim 10, wherein said high surface area support material is alumina.

12. The process of claim 1, wherein said mercaptan decomposition catalyst is comprised of a refractory metal oxide in an effective amount to catalyze the decomposition of said mercaptan sulfur to $H_2S$.

13. The process of claim 12, wherein said mercaptan decomposition catalyst is comprised of materials selected from alumina, silica, silica-alumina, aluminum phosphates, titania, magnesium oxide, alkali and alkaline earth metal oxides, alkaline metal oxides, magnesium oxide, faujasite that has been ion exchanged with sodium to remove the acidity, and ammonium ion treated aluminum phosphate.

14. The process of claim 13, wherein said mercaptan decomposition catalyst is comprised of materials is selected from alumina, silica, and silica-alumina.

15. The process of claim 1, wherein said hydrodesulfurization reaction stage conditions include temperatures from about 500° F. (260° C.) to about 675° F. (357° C.), pressures of about 150 to about 500 psig (about 1,136 to about 3,549 kPa), and hydrogen-containing treat gas rates of about 1000 to about 3000 standard cubic feet per barrel (about 178 to about 534 m3/m3).

16. The process of claim 15, wherein said hydrodesulfurization reaction stage conditions include pressures of about 200 to about 400 psig (about 1,480 to about 2,859 kPa).

17. The process of claim 16, wherein said mercaptan decomposition reaction conditions include temperatures from about 600° F. (316° C.) to about 800° F. (427° C.), and pressures of about 120 to about 470 psig (about 929 to about 3,342 kPa).

18. The process of claim 17, wherein the total sulfur content of said mercaptan decomposition reactor product stream is less than about 5 wt. % of the total sulfur content of said olefinic naphtha feedstream.

19. The process of claim 18, wherein the mercaptan sulfur content of said mercaptan decomposition reactor product stream is less than about 35 wt. % of the mercaptan sulfur content of said first reactor effluent stream.

20. The process of claim 19, wherein the mercaptan sulfur content of said first separator higher boiling point stream is less than about 30 wt. % of the mercaptan sulfur content of said hydrodesulfurization reaction effluent stream.

* * * * *